United States Patent [19]

Larive

[11] 4,130,075

[45] Dec. 19, 1978

[54] PORTABLE CARGO DECKS

[76] Inventor: David G. Larive, 7707 Bryonwood, Houston, Tex. 77055

[21] Appl. No.: 719,919

[22] Filed: Sep. 2, 1976

[51] Int. Cl.[2] ..... B63B 3/48

[52] U.S. Cl. ..... 114/85; 105/370; 105/497; 105/501

[58] Field of Search ..... 114/72, 73, 75, 76, 114/85, 260; 214/12, 14, 15 R, 38 CA, 16.4 A; 294/81 SF, 67 DA; 105/501; 52/578, 585; 105/497, 498, 499, 500, 502, 503, 375, 422, 370, 371

[56] References Cited

U.S. PATENT DOCUMENTS

| | | | |
|---|---|---|---|
| 2,070,586 | 2/1937 | Fitch | 294/81 SF |
| 2,575,751 | 11/1951 | Donnelley | 105/499 |
| 2,627,821 | 2/1953 | Sjogren | 105/499 |
| 3,101,967 | 8/1963 | Wyrough | 294/67 DA |
| 3,380,422 | 4/1968 | Bachko | 114/72 |
| 3,477,392 | 11/1969 | Loomis et al. | 105/370 |
| 3,695,463 | 10/1972 | Weisker et al. | 214/16.4 A |
| 3,830,177 | 8/1974 | Nemec et al. | 114/73 |
| 3,892,436 | 7/1974 | Fathauer | 294/67 DA |
| 3,980,185 | 9/1976 | Cain | 294/67 DA |

*Primary Examiner*—Galen L. Barefoot
*Attorney, Agent, or Firm*—Michael L. Parks

[57] ABSTRACT

In a cargo vessel having a hold for cargo and/or containers, a portable deck with movable deck supports connected to the deck for securing and/or releasing the portable decks in the hold of the vessel; wherein the vessel is provided with support members for receiving the movable deck supports of the portable decks; a female connection on the portable deck for engagement with a lift spreader for the support and movement of the portable deck when the deck is released from being supported by the movable deck supports by receiving a driving force from the lift spreader to move the movable deck supports. This invention further relates to a portable deck which can be lowered into the hold of a vessel and be received by supports in the hold of the vessel for supporting the deck and providing for removal of the deck by retracting the supports from the receiving members in the hold of the vessel.

8 Claims, 11 Drawing Figures

FIG. 1
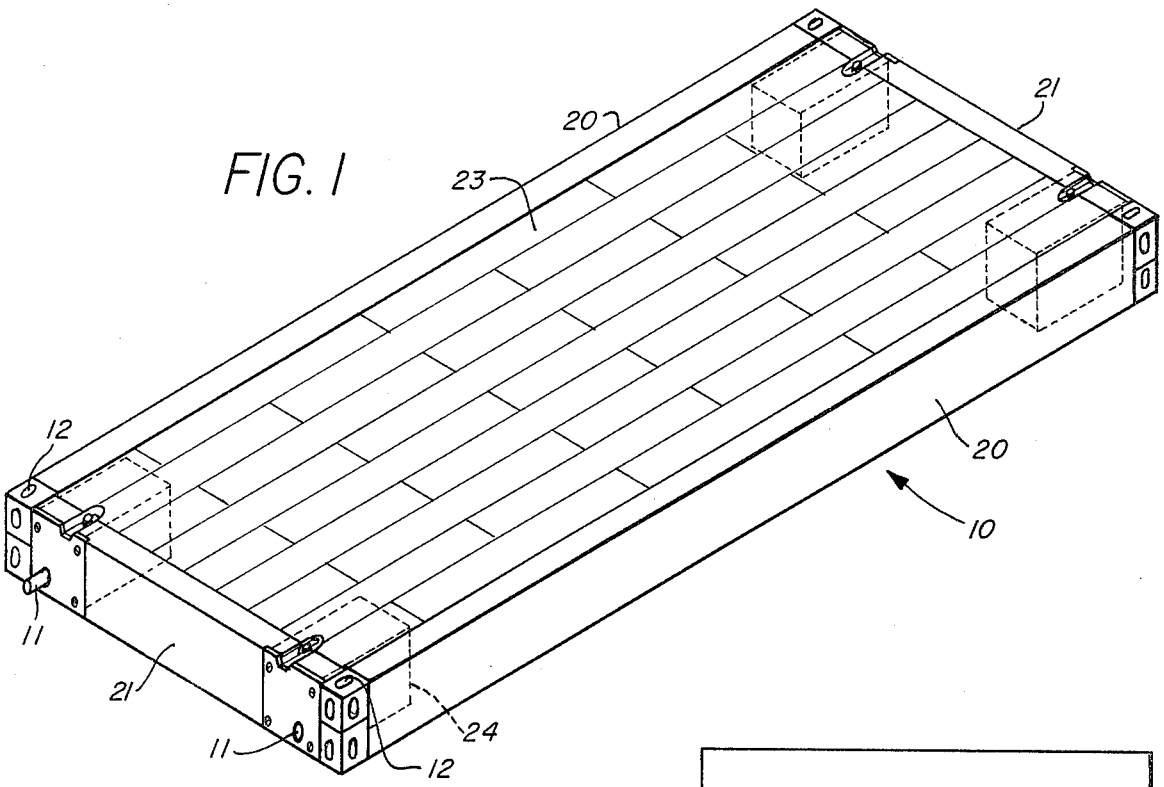
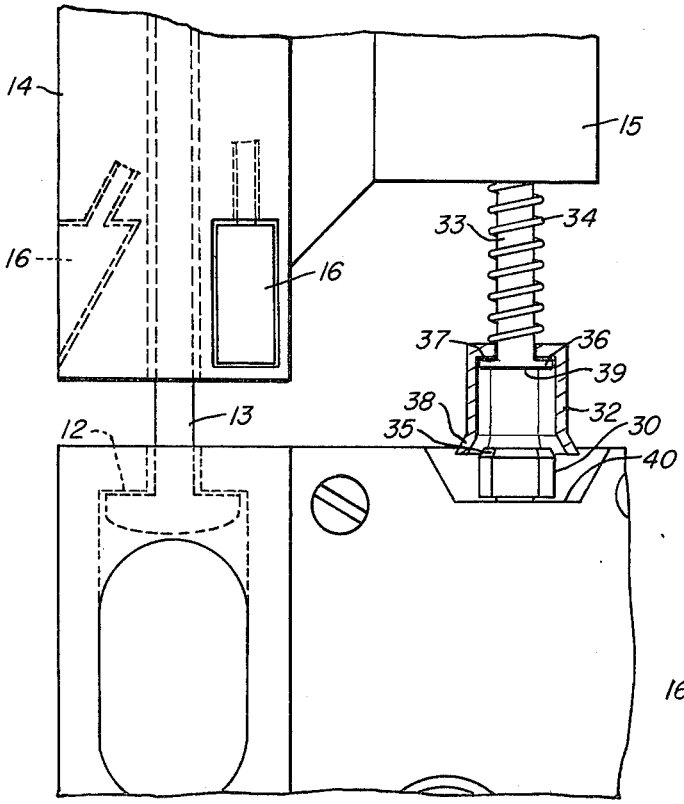
FIG. 8
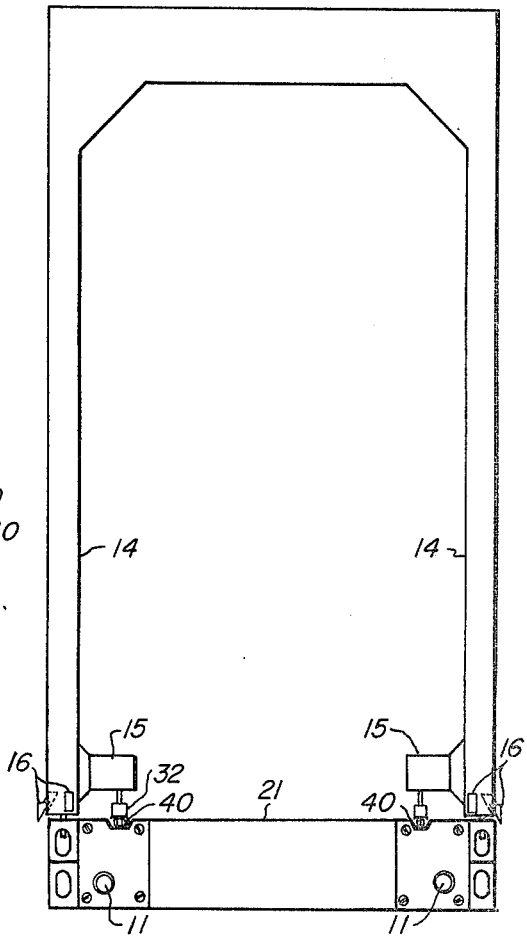
FIG. 7

PORTABLE CARGO DECKS

BACKGROUND OF THE INVENTION

While the prior art dealing with cargo vessel construction and containerized shipping and handling of containerized cargoes is very extensive, the prior art has not developed a portable modular deck which may be used in a general cargo vessel of the type that is a common carrier of widely varying kinds of freight.

For example, the prior art U.S. Pat. No. 3,537,414 issued to Jerome L. Goldman teaches the use of containerized pallets. In this prior art a means is provided for automatically actuating the support elements when the pallet strikes an object such as another pallet below which causes the pallet to automatically extend its supporting elements at the appropriate time. Such a system works well with a uniform sized cargo, such as might be found on a vessel dedicated to carrying semi-finished materials between two factories. The problem with this prior art patent of Goldman, however, is that it is not able to carry a wide variety of types and sizes of general cargo at the same time. For example, if bulk grain were placed in the hold of a vessel and then Goldman's pallets were placed on top of the grain, the actuating means on the pallets would simply bury themselves in the grain. The pallets, therefore, would not attach themselves to the supporting bulkheads of the vessel. Another example is that of the common problem of carrying tall cases of machinery. If Goldman's pallets were sized to average size cases, a tall case would block the actuating mechanism of a pallet placed above it. If the pallets were sized for carrying tall cases, spaced would be wasted when they carried small cases. In any case, such a ship would not be able to carry a wide variety of types of cargo, such as are carried aboard common carries, but only types of cargo that will fit in the pallets.

Also in the prior art the mechanism of the support elements are such that they are manufactured into the pallets and/or containers themselves and thus the whole deck is taken out of service when damage occurs to the support mechanism.

In another example, the prior art of U.S. Pat. No. 3,415,214 issued to Jerome L. Goldman; cargo is stowed on "receivers" which are described as being pallets or containers. The receivers rest upon manually placed support bars that are placed under each corner. The support bars extend from holes in the bulkheads to holes in deep flanges between each receiver. This system has a number of problems that make it impractical: the manual placing of the bars requires that longshoremen be aboard the vessel and that numerous ladders and platforms be available for them to reach the holes. Also this system requires a lot of special construction in the vessel in order to leave holes in the bulkheads and still maintain watertight compartments. Also, it would be very difficult to carry such cargoes as bulk grain or liquids in a vessel built for this system because the grain or liquids would run thru the holes. Also the wide flanges which protrude into the cells would interfere with cargo that might otherwise be placed across two or more of the receivers.

Further, the prior art containers and pallets have not been such that they can be stored in a space less than the spaced that they utilize as carriers of cargo. Such that a container takes up the amount of space that a container takes up whether it is loaded or unloaded and thus, when the container is not in use, it still occupies the same amount of sapce that it would if it were loaded. There is no way that an enclosed container can be rearranged to occupy less space.

Also, in the the prior art the cargo fit inside the container and cannot span across several containers. That is, several pallets placed side by side cannot jointly support layer pieces of cargo because cell structure — guideway structure gets in the way. Also, the prior art has generally dealt with either container vessels or general cargo vessels and the prior art has not attempted to provide a portable deck which can be used in a general cargo vessel as well as in a containerized ship so that the deck allows a general cargo vessel to become a limited containerized ship. Also, by using the portable decks in general cargo vessels better cargo and weight distribution can be perfected because of locating the decks at various positions in the hold of a general cargo vessel; to provide for better and proper weight distribution over the vessel. This is important because it provides greater stability for the sea going vessel, as well as a more dense stowage of the cargo.

OBJECTS OF THE INVENTION

It is an object of this invention to provide portable decks which can function as modular units, which when installed side by side, form a clear continuous open deck spaced across the entire breadth of a cargo vessel hatch or hold. Such a deck can then be used for the stowage of pieces of cargo that are much larger than the individual portable decks.

It is the object of this invention to provide an improved stowage factor for cargoes stowed in what would be the lower hold area in a tween deck vessel.

It is a further object of this invention to provide a portable deck which enables a vessel to handle a wide variety of cargo; bulk and general miscellaneous cargo, including very large items, so that the cargo carried by the vessel can be more varied rather than having to be unitized or containerized.

Also, an object of this invention is to provide a deck which allows the vessel to also carry unitized and containerized cargo mixed throughout the vessel.

It is an object of this invention to provide a deck which can serve as a pallet or platform container for direct loading or packaging at a factory and/or crating yard so that the cargo placed thereon does not have to be re-handled. The deck can be transported on an ordinary highway truck trailer chassis or rail cars.

It is also an object of this invention to provide a portable deck on which the condition of the cargo and the securing of the cargo can be easily seen and inspected on the dock, before placing it in the vessel, thus it will not be necessary for workers and inspectors to board the vessel; in order to stow and secure the cargo.

It is also an object of this invention to provide a portable deck which can handle items which are hard to load into containers; such as pipe, and other difficult to load items.

It is also an object of this invention to provide a quicker unloading and discharge of cargo from the deck and the hold than in conventional cargo ships.

It is also an object of this invention to provide decks which do not require shipyard maintenance and thus, the mechanism can be pulled from the deck and taken to any repair shop for repairs when necessary and a new mechanism inserted into the deck so that the deck is not taken from use while repairs are being made to the mechanism.

Also, this invention would not require that longshoremen be in the hold, or on the vessel, because the deck of this invention can be prestowed on the dock and then dropped into the hold and locked into placed without having a longshoreman present.

The object of this invention is to provide a portable deck which is very simple and easy to maintain and requires little or no special skills to operate.

It is the further object of this invention to provide a portable deck which is considerably more durable and less subject to damage than a container.

It is yet a further object of this invention to provide a portable deck which eliminates overstowing by allowing the decks to be put wherever they are needed in the cargo hold and thus equalize the weight distribution which allows the ship to be more stable at sea.

It is a further object of this invention to provide a portable deck which allows more cargo to be stowed in a vessel than in other types of vessels by allowing the decks to be placed vertically at irregular as well as regular intervals, according to the height of the individual items of cargo stowed thereon. In this way a more densely packed stow is achieved.

It is a further object of this invention to provide a portable deck that can be handled and operated by means of a lift spreader of a type that can also handle containers.

It is a further object of this invention to provide a modular deck so that container or cellular type vessels can be temporarily converted as needed to tweendeck type vessels.

It is a further object of this invention, when carrying bulk grain, to eliminate shifting boards and saucers by placing the decks at a height where they hold the grain in place.

DESCRIPTION OF THE DRAWINGS

Other features, objects and advantages of the invention will become more readily apparent from the accompanying drawings, specification and claims.

FIG. 1 is a perspective view of the portable deck of this invention.

FIG. 7 is an end view of the portable deck showing one end of a special lift spreader connected thereto for lifting.

FIG. 8 is an expanded view of a point of connection between the lift spreader and the portable deck of this invention.

Figure 2:
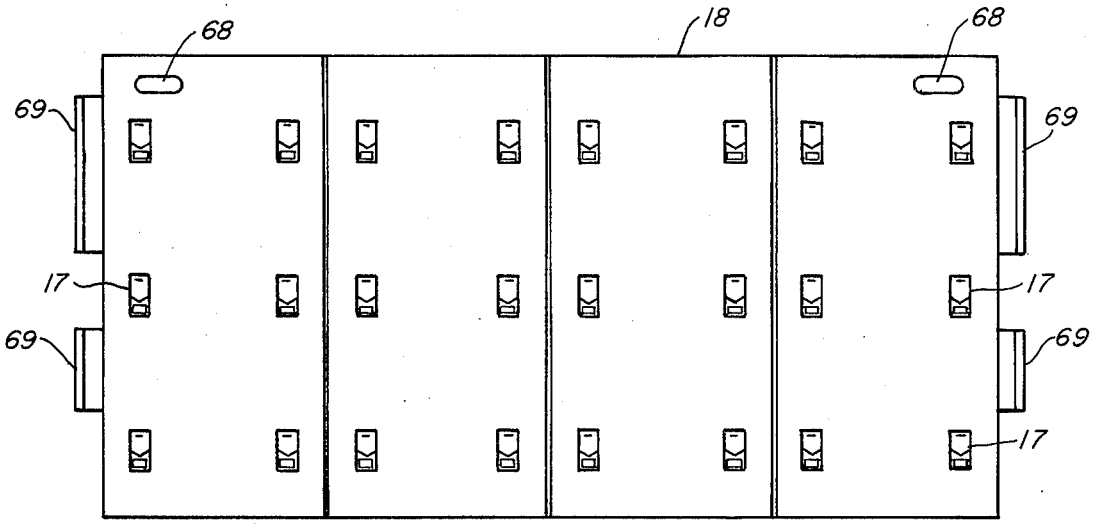
FIG. 2 is a movable partition for use in sectioning certain very long cargo holds of vessels to enable those particular cargo holds to use the portable deck of this invention.

Referring more particularly to the drawings, the portable deck of this invention can best be seen in FIG. 1 as designated by the general reference number 10. The Portable Deck 10 is provided with movable support members 11 which are movably mounted in the Portable Deck 10. The Portable Deck 10 also has provided female members 12 for receiving male members 13 of a lift spreader 14 as can best be seen in FIG. 8. The female members 12 and male members 13 co-operate to provide support for the portable deck 10 when the portable deck 10 is being moved or lifted from the hold of a vessel or dock. Connected proximate the male members 13 are movable support activator 15 for providing the force to move the deck support members 11 out to support the portable deck 10 in the hold of a ship or for retracting the deck support members 11.

Also connected to lift spreader 14 are aligning members 16 for aligning the lift spreader 14 with the portable deck 10 as the lift spreader 14 is put in place over the portable deck 10. The aligning members 16 are movably connected to the lift spreader 14 for movement from a contained position on the lift spreader 14 as shown in FIG. 8 to a flared extended position from the lift spreader 14 for guiding the lift spreader 14 into place over the portable deck 10 as shown in FIG. 7.

The hold of the vessel in this invention must have receiving members 17 connected to the walls and partitions of the hold of the vessel as shown in FIGS. 2, 4, 5 and 6. These receiving members 17 support the portable deck 10 in the hold.

Also in this invention portable partitions 18 are provided for the temporary re-dividing of a long hold 19 of a vessel to allow the vessel to take the portable decks 10 of this invention which provide better utilization of the hold space.

The portable deck 10 of this invention is substantially a flat platform formed from side reinforcing members 20 and end reinforcing members 21 with additional cross-reinforcing members (not shown) between side and end reinforcing members 20 and 21 respectively. The flat platform is formed from flooring 23 which is layed and secured to the side, and end cross-reinforcing members 20 and 21 shown, and end cross-reinforcing (not shown).

Figure 9:
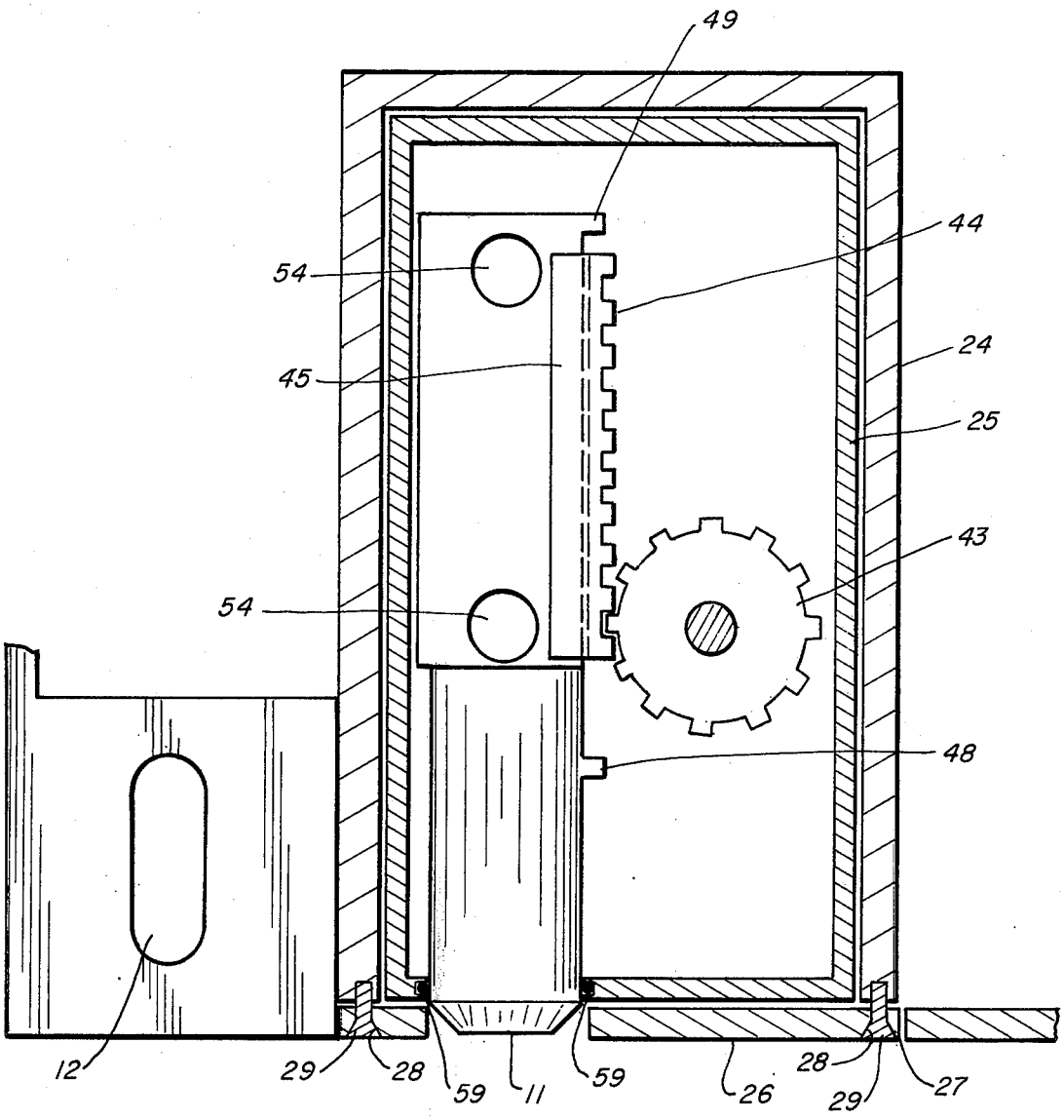
FIG. 9 is a top view of the portable deck in partial cross-section showing part of the interior of the deck support means and mechanism.
Figure 10:
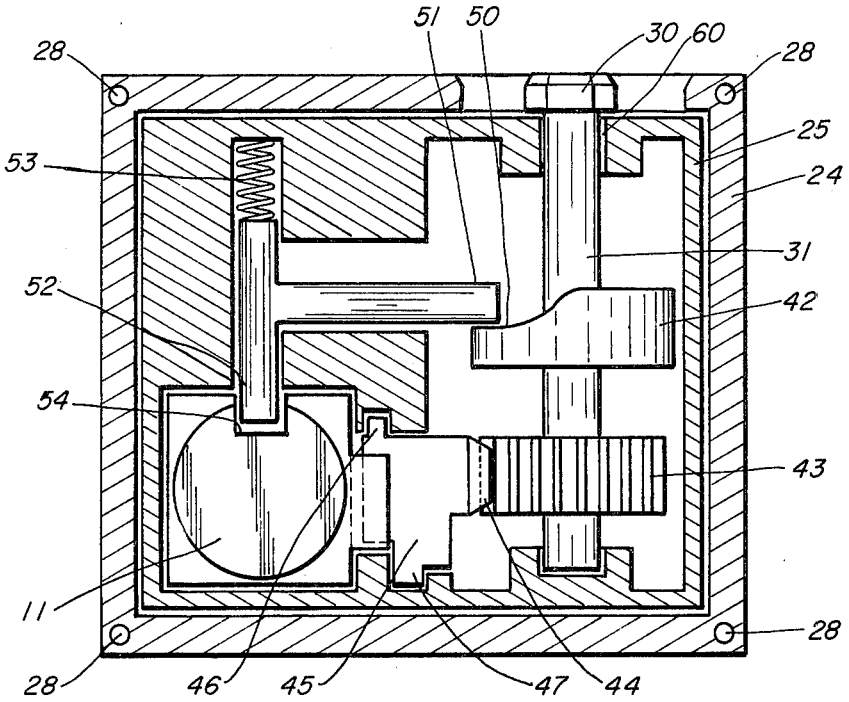
FIG. 10 is a cross-sectional view of the means used to support the portable deck and of the mechanism to retract and protract the support member of the portable deck.
Figure 11:
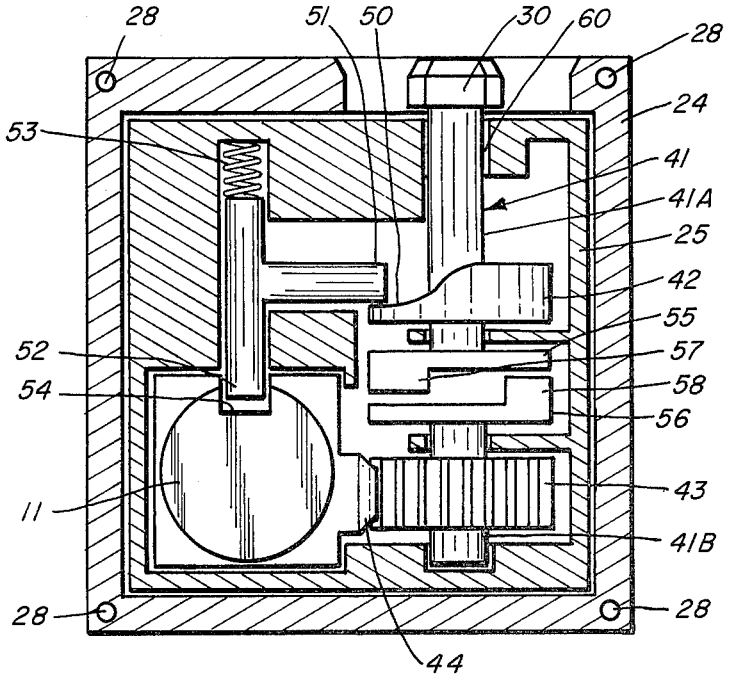
FIG. 11 is an alternative mechanism for retracting and protracting the support member.

The end reinforcing member 21, and its adjoining structure, is adapted to be fitted with a box 24 as best seen in FIG. 9, 10 and 11 which contains a mechanism housing 25 which contains the movable deck support member 11 and the means for moving the deck support member 11 from a lst position to a 2nd position. In this embodiment as shown in FIG. 1 the lst position of the deck support member 11 is flush with the end reinforcing member 21 while in the 2nd position the deck support member 11 is extended from the end reinforcing member 21.

The box 24 has a face plate 26 which extends across the bos 24 to form a flange 27, as best shown in FIG. 9. The flange 27 is provided with bore holes 28 for receiving bolts 29 which fasten the face plate 26 to the box 24 for securing the mechanism housing 25 in the portable deck 10. The face plate 26 holds the mechanism housing 25 inside the box 24. These bolts 29 for fastening the face plate 26 are provided to allow easy removal and repair of the mechanism inside the mechanism housing 25 and for allowing the changing out of one mechanism housing 25 for another mechanism housing 25 while the mechanism in the first housing is being repeated; thus, the portable deck 10 of this invention would not have to be taken out of service while the mechanism in the first housing is being repaired.

The mechanism in mechanism housing 25 also has on one side a drive bolt 30 which extends from the mechanism housing 25 but is flush with the surface of box 24 which is built into the portable deck 10. This drive bolt 30 is connected to a shaft 31 as shown in FIGS. 10 and a shaft 41 as shown in FIG. 11 which is adapted for rotation in the mechanism housing 25. The force for rotating the drive bolt 30 is provided by a torque wrench 32 which is connected to a movable support activator 15, as best shown in FIGS. 7 and 8. The lift spreader 14 is used to engage the portable deck 10 of this invention and move the deck 10 in place on the vessel or dock side.

In FIG. 8 it can be seen that the torque wrench 32 is moveably connected to a shaft 33 which can be rotated from movable support activator 15.

A movable connection of the torque wrench 32 along the shaft 33 is provided by a spring 34 which tends to drive the torque wrench 32 to the shaft end 39. The shaft end 39 is formed into a male ridge member 36. The upper inside surface of the torque wrench 32 is provided with female grooved members 37. The spring 34 drives the torque wrench 32 downward and engages the male ridged members 36 with the female grooved members 37 to form ridged connection for torquing the torque wrench 32. The torque wrench 32 is guided into place by being connected to the lift spreader 14 proximate the point of connection of the male member 13 with the female member 12.

Also the lift spreader 14 is guided into place over the portable deck 10 by aligning members 16 which are movably connected to the lift spreader 14 for movement from a contained position as shown in FIG. 8 to a flared extended position as shown in FIG. 7 to guide the lift spreader 14 into engagement with the portable deck 10. Any conventional driving system may be used to drive the aligning members 16 outward from the lift spreader 14. The aligning members 16 must be retractable to a contained position to prevent inadvertent catching when the lift spreader is dropped into the hold of a vessel.

The torque wrench 32 is placed over the drive bolt 30 when the lift spreader 14 with male member 13 is used to engage the female part 12 of the portable deck 10 so that if the male member 13 and female member 12 are engaged the torque wrench 32 is also in position to drive the drive bolt 30. However, the even further the aid alignment drive bolt 30 has a beveled head surface 35. Also, the torque wrench 32 is provided with a flared mouth 38 to further aid in aligning these sections for engagement. The driving force is provided in a conventional way, as, for example, by means of an impact wrench, and can be remotely activated by radio waves to turn on or off the driving motor to provide the torque needed.

When the lift spreader 14 lifts a deck, the male member 13 inserts into the female member 12 and turns sufficiently to become engaged for lifting the portable deck 10 as shown in FIGS. 7 and 8.

The lift spreader 14 can be used on containers because upon contacting other cargoes or containers the spring 34 compresses, allowing the torqure wrench 32 to retract and be bumped out of the way of the container.

In fitting the mechanism housing 25 into the portable deck 10 an open channel 40 is left in the end reinforcing member 21 and the deck florring 22, for the easy removal, insertion and aligning of the torque wrench 32 over the drive bolt 30. The open channel 40 also provides a self cleaning feature which prevents foreign debris from becoming trapped therein. The open channel 40 permits the entire deck support mechanism in its mechanism housing 25 to be removed from the end of the deck for servicing even when the decks are stacked one upon the other.

The two embodiments of the deck support mechanism, shown in FIGS. 10 and 11 are examples of embodiments which have different lost motion devices contained therein. In one such embodiment the drive bolt 30 is connected to a shaft 31 as shown in FIG. 10 and the shaft 31 is connected to a cam wheel 42 and a drive gear 43 for rotation with the shaft 31. The drive gear 43 is provided for driving a rack gear 44. The rack gear 44 is mounted on a sliding bar 45 and is moved along and held in place for lineal movement by upper and lower tongues 46 and 47 respectively. One side of the rack gear 44 is positioned for engagement with the movable deck support member 11, which in this embodiment is a pin, when the rack gear 44 is moved. Forward and rearward flanges 48 and 49, as best shown in FIG. 9, are provided on the movable deck support member 11 for engaging the rack gear 44 when it is advanced either forward or rearward. The forward and rearward flanges 48 and 49 are shown in this embodiment, spaced forward and rearward of the drive gear 43 and positioned a sufficient distance on either side of the rack gear 44 for the rack gear 44 to be advanced some distance before it engages the forward or rearward flanges 48 and 49 of the moveable deck support means 11 for driving the deck support meas 11 from a 1st position to a 2nd position. The sufficient distances between the rack gear 44 and the forward and rearward flanges 48 and 49 is to provide a lost motion function, so that the shaft 31 may be rotated some prior to advancing or retracting the movable deck support means 11.

The lost motion function above cooperates with the cam wheel 42 to allow the cam wheel 42 to move the cam surface 50 of cam wheel 42 through its caming action prior to the advancement of the movable deck support means 11.

Positioned in caming relationship with the cam surface 50 is a cam lever 51 which rides on the cam surface 50. The cam lever 51 is connected to a detent pin 52 which is moved upward as the cam lever 51 rides on the cam surface 50 as the cam surface 50 is rotated by the turning of the shaft 31 or shaft 41.

One end of the Detent pin 52 is compressed against a spring 53 to keep the detent pin 52 in place and under pressure until moved by the cam lever 51 and the other end is projected toward the movable deck support member 11 which has demi facets 54 machined thereon for receiving the detent pin 52. The detent pin 52 and demi facets 54 are provided to prevent inadvertent movement of the portable deck support member 11; they lock the deck support member 11 in its retracted and/or protracted positions until the detente pin 52 is raised.

In another embodiment the lost motion device is provided as best shown in FIG. 11 where a shaft 41 is split between the point of attachment of the cam wheel 42 and the drive gear 43. Connected between the split in the shaft 41 is a first disk 55 mounted to a shaft section 41A and a second disl 56 mounted to shaft section 41B and the first and second disks 5 and 56 are mounted on shaft 41A and 41B in positions opposite each other. First disk 55 has a raised flange 57 at one section along the outer edge of first disk 55 and the second disk 56 has a raised flange 58 at one section along the outer edge of second disk 56 so that when the first disk 55 and raised flange 57 are rotated the raised flange 58 is engaged by the raised flange 57. After engagement of raised flanges 57 and 58 the torquing motion is imparted to shaft 41B and second disk 56 for driving the drive gear 43. In this embodiment the drive gear 43 drives the deck support member 11 directly through the rack gear 44; which, in this embodiment, attaches directly to the deck support member 11.

The function of the lost motion devices, previously described, is to permit the force which rotates the shafts 31 and 41 to first unlock the movable deck support member 11 before moving it out, or in.

Seals such as o-ring seal 59, in FIG. 9, are provided about the movable deck support member 11 to keep out foreign debris. Also a seal 60, in FIGS. 10 and 11, is provided about shaft 41 and shaft 31 for a similar purpose of keeping the mechanism in mechanism housing 25 free of foreign debris.

Figure 6:
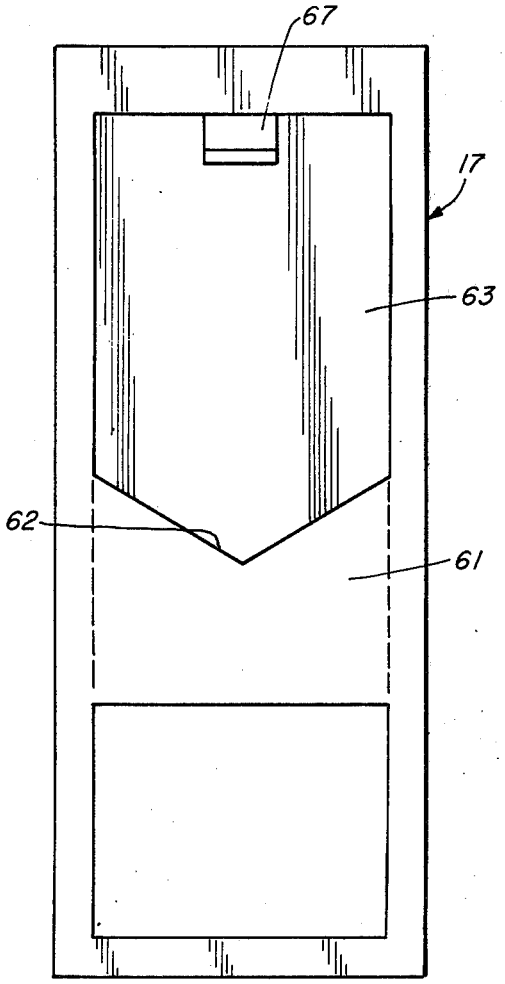
FIG. 6 is a frontal view of the member for receiving the portable deck.
Figure 5:
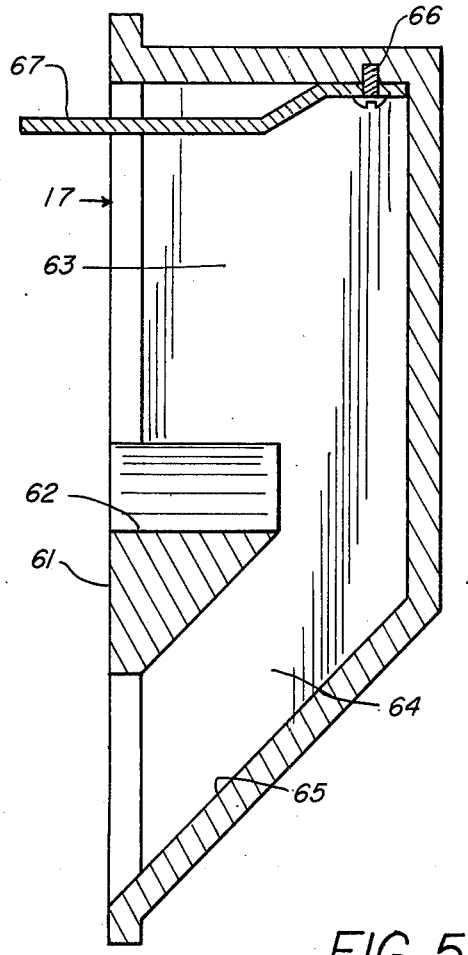
FIG. 5 is a cross-sectional view of the receiving member which fastens to the vessel for use in receiving the portable deck.
Figure 4:
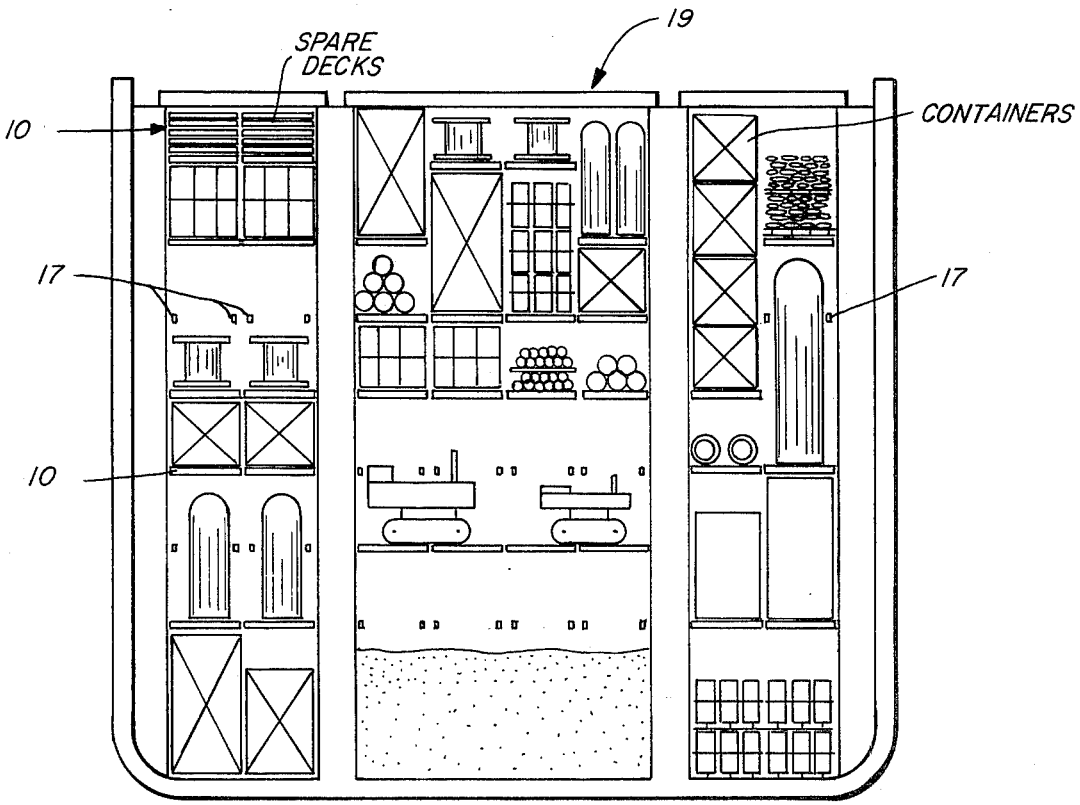
FIG. 4 is a cross-sectional view of a vessel utilizing movable decks of this invention.

In the hold of the vessel receiving members 17, as shown in FIG. 5 and 6, are provided for receiving the movable deck support members 11. The receiving members 17 are welded or otherwise fastened at pre-determined locations in the hold of a vessel as shown in FIGS. 2 and 4. From FIG. 4 it can be seen that the location of the receiving member 17 is such that the hold of a ship using the portable decks of this invention with the receiving members 17 gives better use of the hold cargo spaced because it allows the space to be cut to fit the cargo to be carried. That is, the height and breadth of the space can be varied according to the size of various types of cargo.

The receiving members 17 are formed as shown in FIGS. 5 and 6 for receiving the movable deck support members 11 on a self centering receiving plate 61. The self centering receiving plate 62 which allows the movable support means 11 when extended from the portable deck 10 to come to rest at the point 62 of the self centering receiving plate 61.

The upper opening 63 of the receiving member 17, is much higher and wider than the movable deck support member 11 which is inserted into it. This additional room allows tolerance for the movable deck support member 11 to hunt the point 62. This room also allows the crane to lift the portable deck 10 and take the weight off of the deck support members 11, before the deck support members 11 are retracted. This could be done in the case of a very heavy load of cargo. This additional room also compensates for variations in the list and trim of the ship, so that the ship and the lift spreader do not have to be level with respect to one another.

About the self centering receiving plate 61 is a self cleaning well 64 which allows debris, foreign material and bulk cargo which may be present to pass through and not collect. The lower surface 65 is sloped to an angle greater than the angle of repose of most bulk cargo, such as grain, to cause any such cargo or foreign material to be passed clear of the self cleaning well 64 and the self centering receiving plate 61.

The receiving member 17 also has a secondary function. It can be used as a lashing connection point for securing cargo. For example, the portable decks 10 may be used to convert a cellular vessel to a tweendeck type vessel. Very large pieces of cargo placed on the tween decks can then be secured to the vessel. Securing wires or chains are attached to the receiving plate 61.

Also connected to the top of the receiving member 17 by bolt 66 is a position locator 67. The position locator 67 is a noise maker spring which produces a clanging sound to let the lift spreader operator know that the portable deck 10 is in a position to extend the movable deck support members 11 so that they will come to rest on the self centering receiving plate 61. The position locator 67 is operated by portable deck 10 which strike and bend the position locator 67 as they pass by and they allow it to spring back to make a clanging noise when the portable deck 10 is in position.

In another embodiment (not shown) of a position locator, markings on or near the receiving members 17 could be scanned and read by an electrical system or by an electro-optical system. Such a system would then indicate to the crane operator when the deck and reached the level at which it was to be fastened to the ship.

Figure 3:
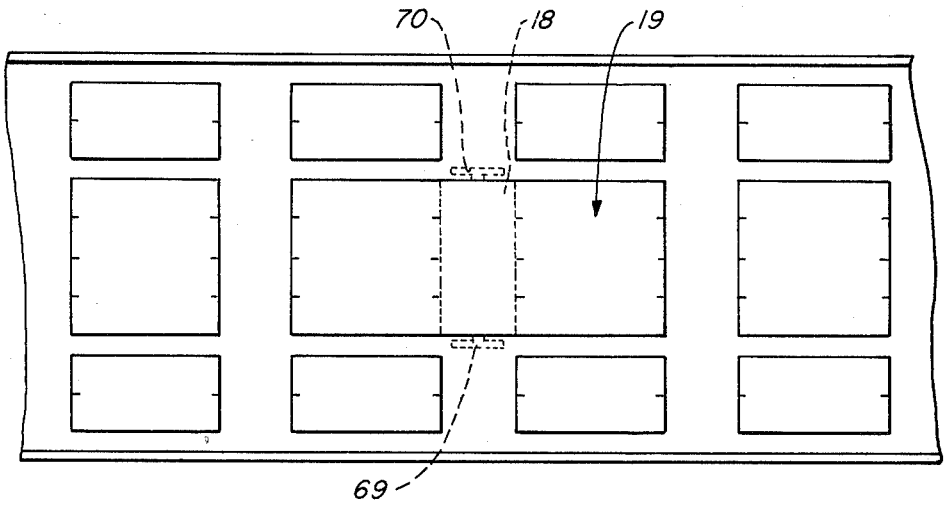
FIG. 3 is a plan view of the deck of a vessel showing the use of the removable partitions in a long hold of a vessel.

The receiving member 17 may be mounted on a portable bulkhead 18 as shown in FIG. 2 for being dropped in place as shown in FIG. 3 in dotted lines. Attachment members 68 are provided for easy engagement by a lifting crane to either remove or place these partitions in the hold 19 of a vessel. These partitions also have T section irons 69 for guiding the portable bulkhead 18 into receiving channels 70 which put the bulkhead into place vertically in the hold of a ship. This portable bulkhead 18 permits a very long hatch 19, as shown in FIG. 3, to be converted to two or more shorter spaces of about the same length as the portable decks 10, so that portable decks 10 may be supported in the hatch. Being able to have the portable decks in a long hatch permits an unusual mix of cargo and eliminates wasted spaced in the hold. For example, in the long hatch shown in FIG. 3, unusually long pieces of cargo such as locomotives and derricks can be stowed in the bottom of the hatch. Next, a section of portable bulkhead can be installed above the locomotives and derricks and finally, the portable decks can be installed, with one of their ends being supported by the portable bulkhead.

While the previous description has been of use in vessels, it should also be understood that railroad cars, trucks and warehouse storage spaces might also make use of these decks.

The foregoing disclosure and description of the invention is illustrative and explanatory thereof, and various changes in the size, shape and materials as well as in the details of the illustrated construction may be made within the scope of the appended claims without departing from the spirit of the invention.

I claim:

1. In a cargo vessel having a hold which allows lift spreaders therein for the movement of cargo or containers comprising (a) a portable deck;

(b) movable pin means removably connected to said portable deck for securing or releasing said portable deck in said hold by moving from a 1st position to a 2nd position in said deck;

(c) a drive means connected to said movable pin means for movement of said movable pin means;

(d) a detaining means movable connected to said deck and positioned adjacent said movable pin means for preventing inadvertent movement of said movable pin means from said 1st and 2nd position;

(e) lost motion means connected to said drive means for retracting said detaining means from said movable pin means prior to movement of said pin means by said drive means.

2. In a cargo vessel as in claim 1 wherein said lost motion means connected to said drive means for retracting said detaining means further comprises:

(a) a caming means connected to said drive means for retracting said detaining means as said caming means is advanced.

3. In a cargo vessel as in claim 2 wherein said lost motion means connected to said drive means for retracting said detaining means further comprises:

(a) a slide member movably connected to said drive means for sliding movement adjacent said movable pin means in response to said drive means; and (b) flange means connected to said movable pin means for engagement with said slide member for movement of said pin means after said detaining means is retracted by said caming means.

4. In a cargo vessel as in claim 2 wherein said lost motion means connected to said drive means for retracting said detaining means further comprises:

(a) a 1st shaft member having an engaging surface thereon connected to said driving means; and (b) a 2nd shaft member having an engaging surface thereon connected in said drive means for being engaged with said engaging surface of said 1st shaft member after said detaining means is retracted by said caming means.

5. In a cargo vessel having a hold which allows lift spreader therein for the movement of cargo or container comprising:

(a) a portable deck;

(b) a lift spreader;

(c) movable pin means removably connected to said portable deck for securing or releasing said portable deck in said hold by moving said pin means from a 1st position to a 2nd position in said deck;

(d) a drive means connected to said movable pin means for movement of said movable pin means;

(e) a detaining means movably connected to said movable deck and positioned adjacent said movable pin means for preventing inadvertent movement of said movable pin means from said 1st or 2nd position;

(f) lost motion means connected to said drive means for retracting said detaining means from said movable pin means prior to movement of said pin means by said drive means;

(g) receiving means connected on said vessel in said hold of said vessel for receiving said movable pin means and for directing said movable pin means to a predetermined resting place;

(h) a torque means extendably connected to said lift spreader for extending said torque means from an extended 1st position to a retracted 2nd position and for driving said drive means when said lift spreader and portable deck are engaged; and (i) aligning means movably connected to said lift spreader for movement from a contained position on said lift spreader to a flared extended position from said lift spreader for guiding said lift spreader into engagement with said portable deck.

6. A cargo vessel as in claim 5 wherein said extensible means is retracted when said lift spreader is unengaged with said deck and is extendable after engagement of said lift spreader with said deck.

7. In a cargo vessel of claim 6 further comprising an indicating means connected to said receiving means for indicating when said portable deck is in position for the securing of said portable deck in said receiving means.

8. In a cargo vessel of claim 7 wherein said indicating means is a flexible extended member connected at the top of said receiving means for indicating when said portable deck is in position for the securing of said portable deck by making a noise as said portable deck passes thereby.

* * * * *